US005176089A

United States Patent [19]

Jonsson

[11] Patent Number: 5,176,089

[45] Date of Patent: Jan. 5, 1993

[54] POWER PLANT WITH COMBUSTION OF A FUEL IN A FLUIDIZED BED

[75] Inventor: Arne Jonsson, Finspong, Sweden

[73] Assignee: ABB Stal AB, Sweden

[21] Appl. No.: 741,493

[22] PCT Filed: Feb. 8, 1990

[86] PCT No.: PCT/SE90/00084

§ 371 Date: Oct. 10, 1991

§ 102(e) Date: Oct. 10, 1991

[87] PCT Pub. No.: WO90/09550

PCT Pub. Date: Aug. 23, 1990

[30] Foreign Application Priority Data

Feb. 10, 1989 [SE] Sweden ..... 8900461

[51] Int. Cl.[5] ..... F23J 3/00

[52] U.S. Cl. ..... 110/245; 110/259; 122/4 D

[58] Field of Search ..... 110/245, 249; 122/4 D

[56] References Cited

U.S. PATENT DOCUMENTS 4,227,488 10/1980 Stewart et al. ..... 122/4 D 4,628,834 12/1986 McKelvie ..... 110/245 X 4,655,147 4/1987 Brannstrom et al. ..... 110/245 X

*Primary Examiner*—John C. Fox

*Attorney, Agent, or Firm*—Pollock, Vande Sande & Priddy

[57] ABSTRACT

The invention relates to a power plant with combustion of a fuel at a pressure exceeding the atmospheric pressure in a fluidized bed (18) of particulate material, a so-called PFBC power plant. A combustor (12) is enclosed within a pressure vessel (10) and surrounded by compressed combustion air. Ash chambers (44) in the lower part of the combustor (12) are enclosed in one or more spaces (50) with walls (52, 53) which are suitably designed as plane, water-cooled panel walls. The ash chambers (44) are designed with uncooled walls (62). Pressure equalizing openings (64) are provided in the ash chamber walls (62), which openings equalize any pressure differences which may arise between the ash chambers (44) and the surrounding space (50). The walls (52, 53) which form the space surrounding the ash chambers absorb the pressure difference between the ash chambers (44) and the space (32) between the combustor (12) and the pressure vessel (10).

7 Claims, 4 Drawing Sheets

POWER PLANT WITH COMBUSTION OF A FUEL IN A FLUIDIZED BED

TECHNICAL FIELD

The invention relates to a power plant with combustion of a fuel at a pressure exceeding the atmospheric pressure in a fluidized bed of particulate material in a combustor placed inside a pressure vessel and surrounded by compressed combustion air in the space between the pressure vessel and the bed vessel, a so-called PFBC power plant. PFBC are the initial letters of the English expression Pressurized Fluidized Bed Combustion.

BACKGROUND ART AND THE TECHNICAL PROBLEM

Combustors with combustion of a fuel, usually coal, in a fluidized bed are advantageously constructed with a so-called open bottom consisting of parallel air distributing tubes for combustion air to a combustion space above the bottom and with one or—in large combustors—several funnel-shaped ash chambers below the air distributing bottom tubes. Residual products, residues from the fuel and consumed bed material absorbent, pass in gaps between the air distributing tubes to the ash chamber or ash chambers. The gaps between the tubes should be of such a size that slag lumps formed during normal operation may pass freely through the gaps so as not to disturb the combustion. It is desirable that the downwardly-directed flow to the ash chamber is evenly distributed over the cross section of the combustor. To obtain a small overall height and a uniform material flow, therefore, large combustors are formed with a plurality of ash chambers with a rectangular cross section nearest the combustor bottom. The ash chambers may have the shape of a pyramid turned upside down, or of a funnel of rectangular cross section which changes into a circular cross section so that its lowermost part has the shape of a cone. A power plant with a combustor of this kind is described in greater detail in European patent application A1 289 974.

Between the ash chambers and the surrounding space in the pressure vessel, the pressure difference may amount to about 1 bar, which means that they are subjected to great forces. Since the temperature is high also in the ash chamber, especially in the uppermost part, the ash chamber walls have been constructed as cooled panel walls which are traversed by cooling water to attain a satisfactory strength. Constructing the ash chambers with water-cooled panel walls in a combustor with a plurality of ash chambers complicates the design and entails high costs of manufacture and erection.

SUMMARY OF THE INVENTION

The present invention aims to simplify and render less expensive the ash chamber section of the combustor. According to the invention, the combustor is designed with a plurality of ash chambers which are all or in groups enclosed in spaces which are separated from the space between the combustor and the pressure vessel. In this way the ash chamber walls will not be subjected to forces caused by a pressure difference between the ash chamber and the surroundings. By providing pressure equalizing openings in the ash chamber walls, pressure equalization is achieved between the ash chamber and the surrounding space when the operating pressure of the plant changes upon variations of the load.

The ash chamber walls only support the load from the bed material and residual products from the combustor and sufficient strength may be imparted to them also at a relatively high wall temperature. Therefore, they do not have to be designed as cooled walls, which entails a simple design and a low cost. The pressure difference between the ash chamber and the space between the combustor and the pressure vessel is absorbed by the walls around the space which surrounds the ash chamber. These are plane and simple to manufacture even if designed, as water-cooled, panel walls. The forces acting on the walls are absorbed partly as bending stresses in the walls and partly by supports connecting the walls to each other and/or by supports connecting the walls to a framework.

Other characteristics of the invention will be clear from the appended claims.

BRIEF DESCRIPTION OF THE DRAWINGS

The invention will be described in greater detail with reference to the accompanying drawing, wherein FIGS. 1 and 2 schematically show two embodiments of a PFBC power plant to which the invention is applied.

DESCRIPTION OF THE PREFERRED EMBODIMENTS

Figure 1:
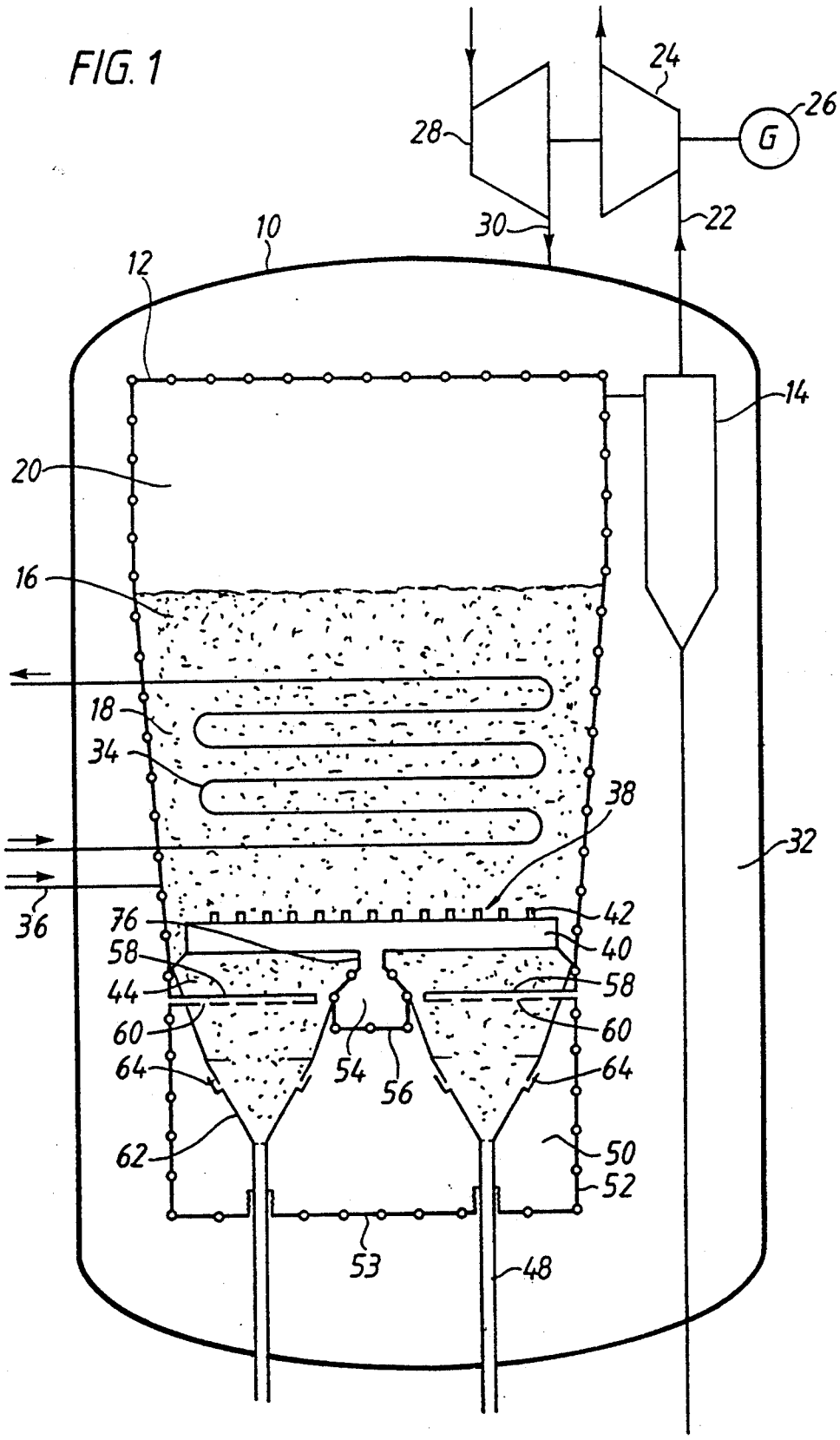
Figure 2:
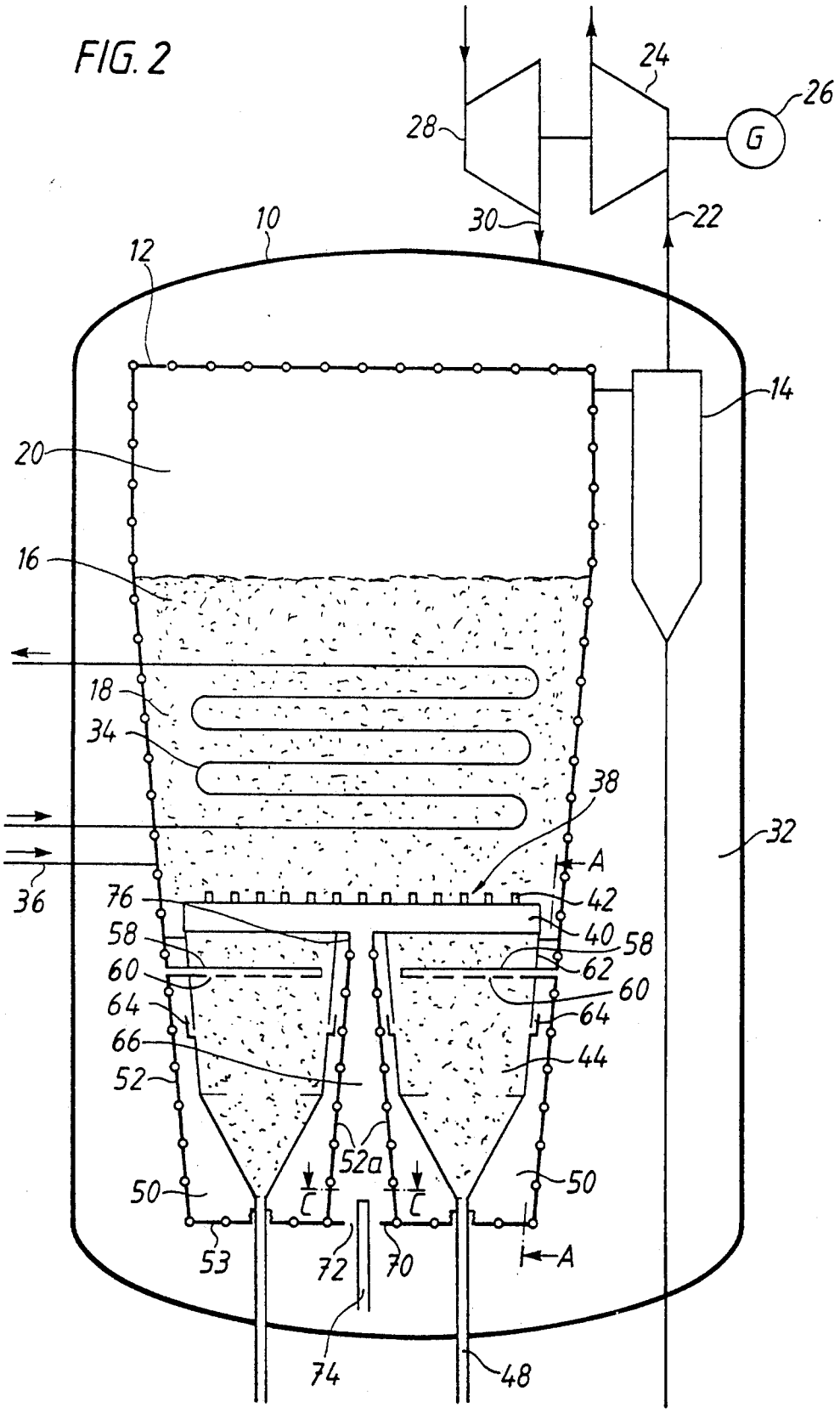
Figure 3:
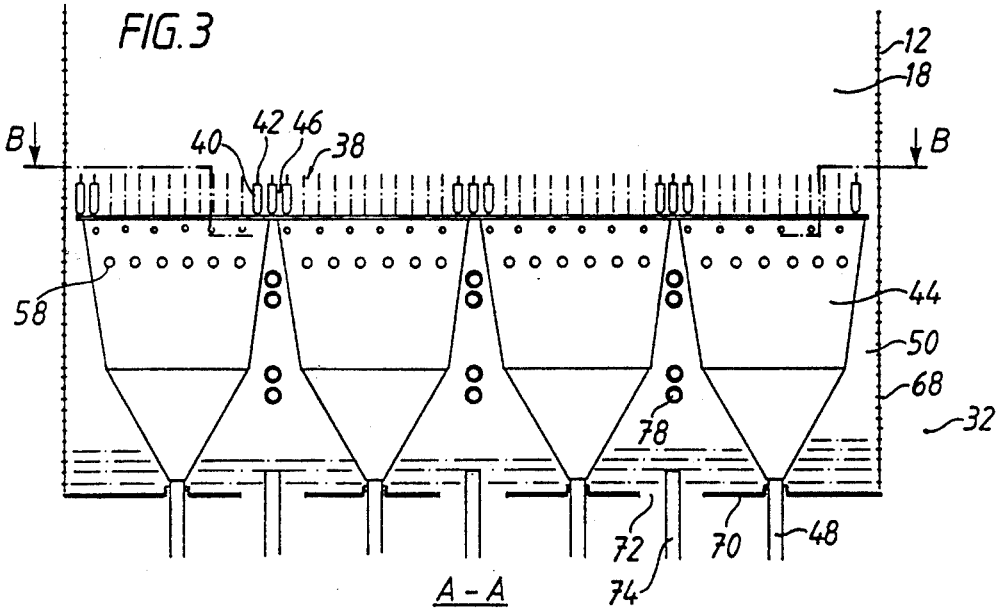
FIG. 3 shows a section according to A—A in FIG. 2.
Figure 4:
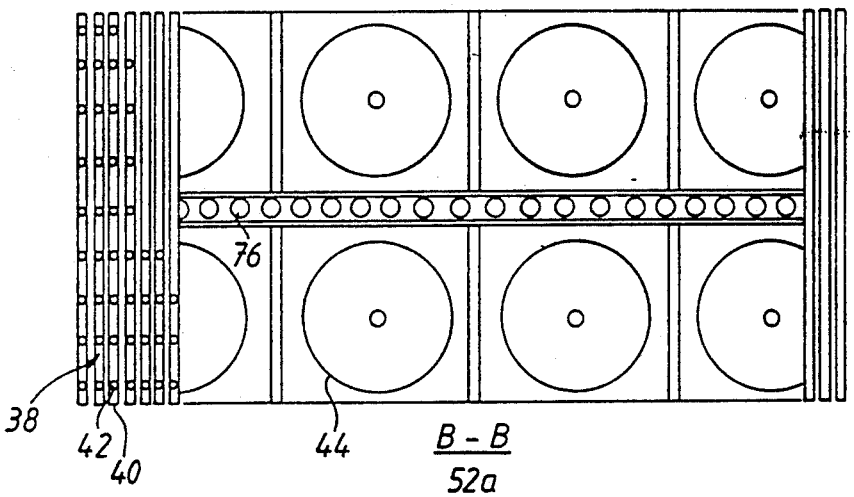
FIG. 4 shows a section according to B—B in FIG. 3.
Figure 5:
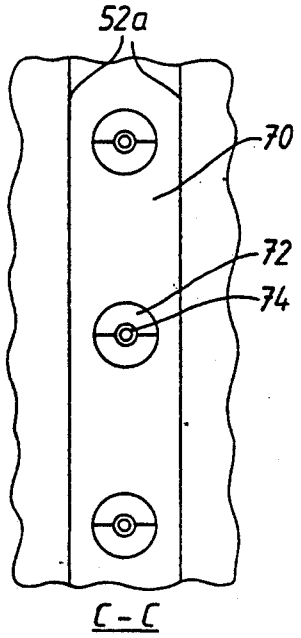
FIG. 5 shows a section according to C—C in FIG. 2.
Figure 6:
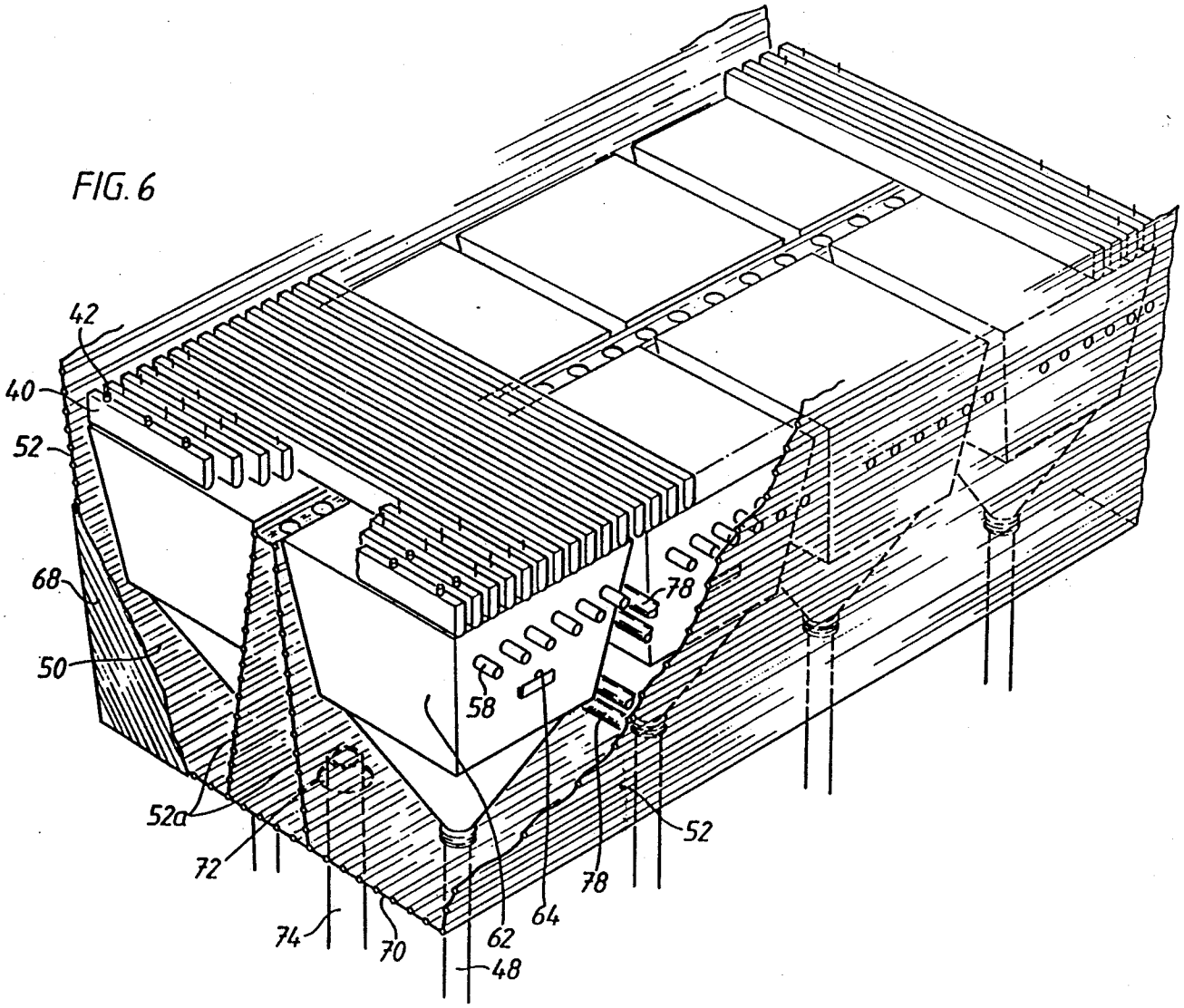
FIG. 6 shows a perspective sketch, partly in section, of the lower part of a combustor.

In the figures, 10 designates a pressure vessel. In it are placed a combustor 12 and a cleaning plant 14, symbolized by a cyclone, for separation of dust from combustion gases generated upon combustion of a fuel in a fluidized bed 16 in the combustion space in the combustor 12. The combustion gases are collected in the freeboard 20, are cleaned in the cleaning plant 14 and are passed in the conduit 22 to the turbine 24. The turbine 24 drives a generator 26 and a compressor 28 which, by way of the conduit 30, supplies the space 32 between the pressure vessel 10 and the combustor 12 and the cleaning plant, 14 with compressed combustion air. The combustion space 18 of the bed vessel accommodates tubes 34 for generation of steam to a steam turbine (not shown). Fuel is supplied to the combustor 12 through the conduit 36 and nozzles (not shown).

The combustor 12 is provided with an open bottom 38 consisting of a number of elongated air distributing tubes 40 with air nozzles 42 for the supply of combustion air for fluidization of the bed 16 and combustion of the supplied fuel. This bottom 38 divides the combustor 12 into an upper part with the combustion space 18 and the freeboard 20, and a lower part consisting of a number of funnel-shaped ash chambers 44. In large combustors the provision of a plurality of ash chambers means that no complicated internal devices are needed in the ash chambers for controlling the ash flow towards an outlet. The necessary height for a good ash flow is reduced. The stresses in the ash chamber walls are low because of a small volume of material in each one of the ash chambers. Between the tubes 40 there are openings 46 in which bed material and residual products may pass to the ash chambers 44 and be discharged through conduits 48 and discharge devices (not shown). The ash chambers 44 are funnel-shaped with an upper rectangular part which is connected to one single conical part.

In the embodiment shown in FIG. 1 all ash chambers 44 are enclosed within a common space 50 which is surrounded by water-cooled panel walls 52 and a water-cooled panel bottom 53. Air from the space 32 is supplied to the tubes 40 through the transversely extending channel 54 with cooled walls 56. The ash chambers 44 are supplied with special, cooled air for cooing the ashes via tubes 58 with nozzles 60. The walls 62 of the ash chambers 44 are provided with pressure equalizing openings 64 which equalize the pressure between the ash chamber 44 and the surrounding space 50. These openings prevent a significant pressure difference from arising between the ash chamber 44 and the space 50. Since the ash chamber, walls 62 need not absorb, forces by the pressure difference but only from the material in them, which is cooled by air to a certain extent, it is possible to design the ash chamber walls uncooled. This is of great value since they have a complicated shape and an embodiment with water-cooled panel walls entails a much more expensive design. The walls 52 around the space 50, which absorb the pressure difference instead of the ash chamber walls 62, are plane, simple to manufacture and may easily be supported or provided with frames for absorbing forces arising as a result of the pressure difference. They may be designed uncooled or as water-cooled panel walls as in FIG. 1. Openings 64 in the ash chamber wall 62 are designed as ash locks.

In the embodiment shown in FIGS. 2–5 the ash chambers 44 are divided into two parallel groups. These groups are each enclosed in space 50. The confronting walls 52*a* form a narrow duct 66 which at its ends is defined by end plates 68 and by a bottom 70 with openings 72. Air from the space 32 is supplied to the tubes 40 through the duct 66. Start-up burners or start-up combustors 74 may be provided in the openings 72. The duct 66 and the air tubes 40 communicate with each other by way of sleeves 76 (thermosleeves) which allow thermal movement between the tubes 40 and the duct 66.

The forces on the plane walls 52 which arise because of the pressure difference, up to about 1 bar, between the space 50 and the space 32 are great. To reduce the bending stresses in the panel walls, these are connected to each other by means of load-supporting supports 78 and/or connected by means of load-absorbing frameworks (not shown).

I claim:

1. A power plant with combustion of a fuel, primarily coal, at a pressure exceeding the atmospheric pressure in a fluidized bed of particulate material, comprising:

a combustor enclosed in a pressure vessel and surrounded by compressed combustion air in a space between the combustor and the pressure vessel, a plurality of parallel air distributing tubes with nozzles which form as bed bottom and divide the combustor into an upper part which includes a combustion space and a freeboard above the fluidized bed, and a lower part which forms at least two ash chambers for the discharge of ashes and consumed bed material, gaps between the air distributing tubes, through which ashes and bed material may pass from the combustion space to the ash chambers, a duct located below the bed bottom and between the ash chambers from which the air distributing tubes are supplied with combustion air from the space between the combustor and the pressure vessel for fluidization of the bed and combustion of the fuel in the bed, and wherein at least one of the ash chambers is enclosed within a space which is delimited from the space for compressed combustion air in the pressure vessel.

2. A power plant according to claim 1 comprising a plurality of spaces which are separated from the space for compressed air in the pressure vessel and wherein each of these spaces surrounds at least one of the ash chambers.

3. A power plant according to claim 2, wherein the walls of the ash chambers are provided with openings for equalizing the pressure between the ash chambers and the surrounding space.

4. A power plant according to claim 1, wherein:

the combustor is rectangular, and has a plurality of separate ash chambers arranged in at least two parallel rows, the parallel rows of ash chambers are each enclosed within an elongated space with cooled walls, and wherein the air distributing tubes communicate with a duct formed between said elongated spaces.

5. A power plant according to claim 4, wherein:

said duct between the elongated spaces with cooled walls is defined from the space formed between the pressure vessel and the combustor by a bottom wall and end walls, wherein openings are provided at the bottom, and wherein start-up burners or start-up combustors are provided in or adjacent to said openings.

6. A power plant according to claim 5, wherein force-absorbing elements are provided which connect together the cooled walls of the spaces surrounding the ash chambers.

7. A power plant according to claim 1 wherein the walls of the ash chambers are provided with openings for equalizing the pressure between the ash chambers and the surrounding space.

* * * * *